US006161341A

United States Patent [19]

Anderson

[11] Patent Number: 6,161,341

[45] Date of Patent: Dec. 19, 2000

[54] SIMULATED TIME SHIP DINING AND ENTERTAINMENT ARRANGEMENT

[76] Inventor: Kent G. Anderson, 925 N. Griffin, Bismarck, N. Dak. 58501

[21] Appl. No.: 09/228,495

[22] Filed: Jan. 11, 1999

Related U.S. Application Data

[60] Provisional application No. 60/877,138, Mar. 3, 1998.

[51] Int. Cl.[7] ..... E04H 3/02

[52] U.S. Cl. ..... 52/68; 52/143; 52/6; D25/19; 472/136

[58] Field of Search ..... 52/68, 69, 143, 52/6, 8; D25/7, 19; 472/130, 136, 61

[56] References Cited

U.S. PATENT DOCUMENTS

| | | | |
|---|---|---|---|
| 1,417,736 | 5/1922 | Heygate | 52/69 |
| 1,957,947 | 5/1934 | Dreyfuss | 52/6 |
| 2,166,577 | 7/1939 | Beckius | 52/169.1 |
| 2,792,794 | 5/1957 | Miller | 52/66 |
| 3,107,400 | 10/1963 | Anderson | 52/69 |
| 3,487,595 | 1/1970 | Schumann | 52/8 |
| 3,701,224 | 10/1972 | Mozier | 52/27 |
| 4,274,233 | 6/1981 | Currier | 52/33 |
| 4,306,388 | 12/1981 | Yuter | 52/6 |
| 5,461,832 | 10/1995 | Smith | 52/69 |
| 5,855,520 | 1/1999 | Gitter et al. | 472/63 |

*Primary Examiner*—Beth A. Stephan
*Assistant Examiner*—Brian E. Glessner
*Attorney, Agent, or Firm*—David A. Lingbeck

[57] ABSTRACT

A simulated time ship dining and entertainment arrangement includes a building structure shaped like a dome and having outer side walls hingedly connected to a roof, inner side walls spaced from the outer side walls and forming display chambers therebetween, a ceiling supported by a simulated engine which is a transparent column resting upon a floor and supporting a dining table; multiple seating members disposed about upon the floor; multiple overhead display modules suspended from the ceiling and floor display modules both of which having image/sound producing equipment, lighting members and memorabilia disposed therein for simulating travel through various time periods; feet members and wheels for supporting and moving the building structure; and communications system for operating the image/sound producing equipment and for communicating to the host and for selecting the time period desired for a unique dining and entertainment arrangement.

14 Claims, 9 Drawing Sheets

SIMULATED TIME SHIP DINING AND ENTERTAINMENT ARRANGEMENT

This application claims benefit to U.S. provisional application 60/877,138 filed Mar. 3, 1998.

BACKGROUND OF THE INVENTION

This invention relates to a dining and entertainment arrangement which is structured like that of a time ship which will make the patrons feel as if they are traveling through outer space and through different time periods while dining out.

Most eating establishments which also offer entertainment have the usual setup which includes tables, booths, chairs, counters and even maybe stages and various displays of fixtures such as paintings, pictures, figurines, and statues. Some even have setups which depict various time periods such as the fifties where the dining arrangement includes a nineteen fifty seven Chevrolet car set up like that of a booth with a table fixed inside the car.

Other prior art includes an ENTERTAINMENT CENTRE WITH MULTIPLE SEPARATE ENTERTAINMENT AREAS, U.S. Pat. No. 3,487,595, which comprises an entrance and lobby which communicates with a plurality of enclosed entertainment areas arranged around the periphery of a control booth having light and sound controls therein. Each of the entertainment areas communicate with the control booth whereby a separate event may occur in each of the entertainment areas with the light and sound being controlled therein.

Another known prior art is a RESTAURANT ENTERTAINMENT SYSTEM, U.S. Pat. No. 4,306,388, which comprises a bar area, a dance floor, a bandstand, and a second counter.

Another known prior art is a RESTAURANT ARRANGEMENT INCLUDING DINING TABLES ON SIMULATED BOATS, U.S. Pat. No. 3,701,224, which comprises a body of water and a plurality of platforms such as simulated boats disposed thereon and accessible by diners with each platform supporting facilities for individual dining parties.

Another known prior art is a BUILDING LAYOUT FOR RESTAURANT AND ARTIST WORK/EXHIBIT AREA, U.S. Pat. No. 4,274,233, which comprises a plurality of dining tables and a plurality of artist work areas located around the periphery of the restaurant dining area.

None of the prior describes or discloses an individual dining and entertainment arrangement of the present invention.

SUMMARY OF THE INVENTION

The present invention relates to a simulated time ship dining and entertainment arrangement comprising a building structure which is essentially a dome-like structure having inner side walls and outer side walls forming display chambers therebetween, and further having a floor with display modules disposed therein and thereunder and further having a transparent cover thereover through which a patron can view various memorabilia disposed therein or upon which images can be projected to simulate the movement of the simulated time ship, and also having a ceiling with a plurality of transparent modules either being suspended from the ceiling or disposed in the ceiling. The simulated time ship is conventionally mounted upon wheels which facilitate the moving of the dome-like structure to any location desired, and also has feet with storage compartments inside thereof for storage and also for supporting image/sound producing equipment which is used to project moving and stationary images on the outside of the outer side walls. Further, the simulated time ship also has an entrance through which to enter the simulated time ship with speakers disposed at the entrance and also inside the dome-like structure to further create an atmosphere of moving through time. Inside the simulated time ship, there is a simulated engine securely attached to the floor and extending upwardly to the ceiling, and there are additional speakers and conventional projection means securely disposed on the ceiling with the conventional image/sound producing projection means being used to project images on the inner walls of the simulated time ship. In addition, there are also conventional image/sound producing projection means mounted in the display chambers between the outer wall and inner wall and also various memorabilia displayed in the display chamber and being visible through the plurality of windows in the inner wall. A dining table is essentially mounted to and surrounds the engine with seating structures disposed about the dining table. The patrons can control what they see and the time they are passing through by means of a control panel which includes conventional volume control knobs, lighting control switches, intercoms, and projection means control knobs and switches.

One objective of the present invention is to provide a simulated time ship dining and entertainment arrangement which will entertain and educate the patrons while dining.

Another objective of the present invention is to provide a simulated time ship dining and entertainment arrangement which will allow the patrons to experience different time periods and historic events.

Further, another objective of the present invention is to provide a simulated time ship dining and entertainment arrangement which will make the patrons believe they are moving through time.

Also, another objective of the present invention is to provide a simulated time ship dining and entertainment arrangement which allows the patrons to control which time periods they would like to travel in and through by means of a control panel.

Yet, another objective of the present invention is to provide a simulated time ship dining and entertainment arrangement which separates the patrons wanting to experience a particular time period from other patrons wanting to experience a different time period.

Further objectives and advantages of the present invention will become apparent as the description proceeds and when taken in conjunction with the accompanying drawings wherein:

DETAILED DESCRIPTION OF THE INVENTION

Figure 1B:
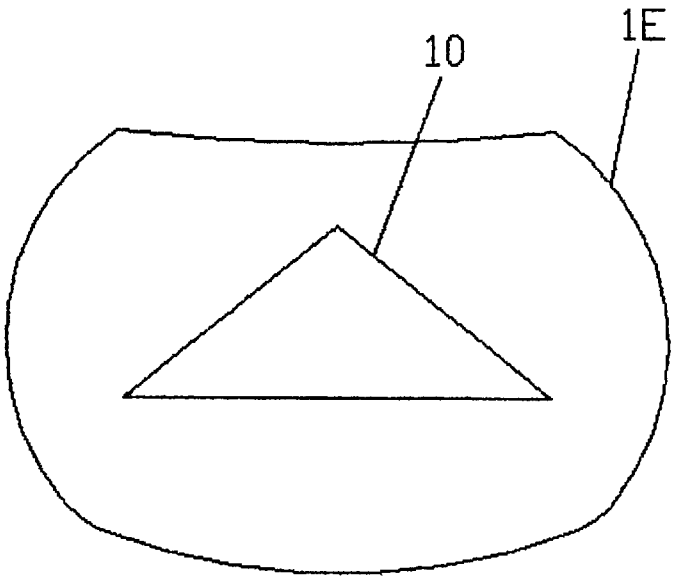
FIG. 1B is a front elevational view of a window located inside the simulated time ship dining and entertainment arrangement.
Figure 1A:
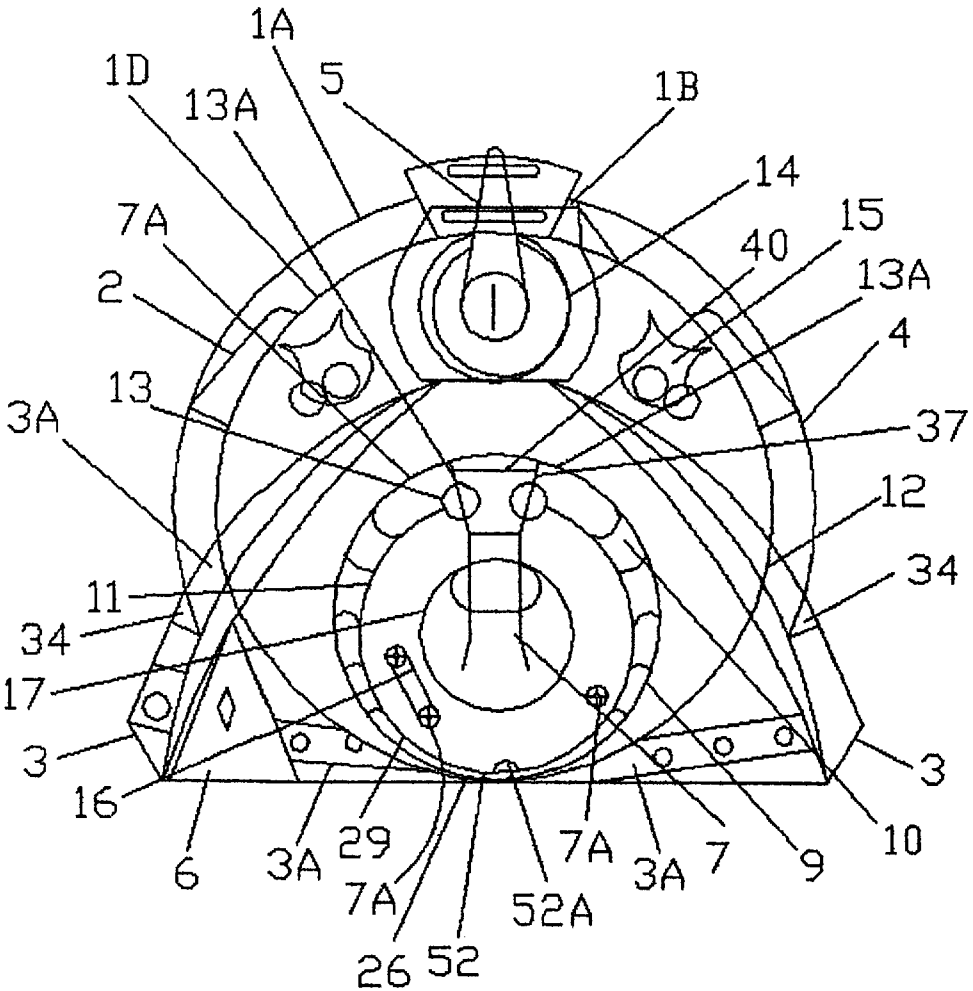
FIG. 1A is a front elevational view of the simulated time ship dining and entertainment arrangement.
Figure 1C:
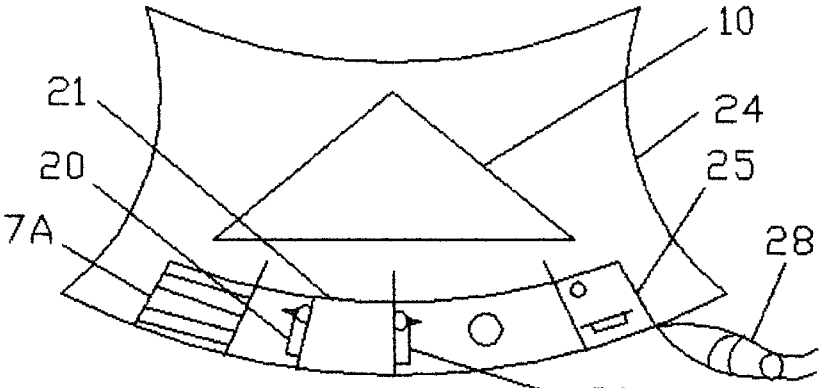
FIG. 1C is a rear elevational view of an outer back side wall of the simulated time ship dining and entertainment arrangement.
Figure 2B:
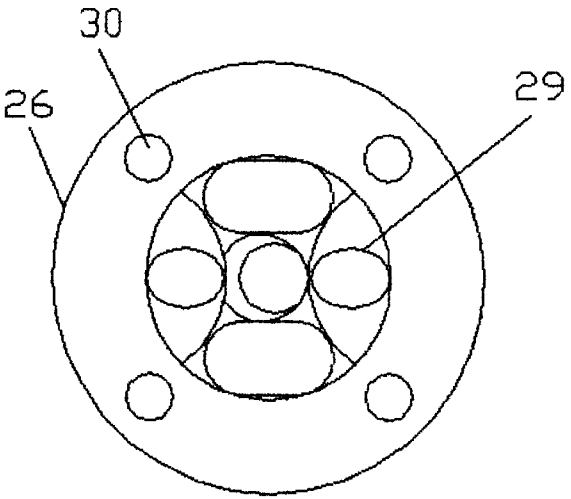
FIG. 2B is bottom plan view of the floor including the wheels on the bottom of the simulated time ship dining and entertainment arrangement.
Figure 2A:
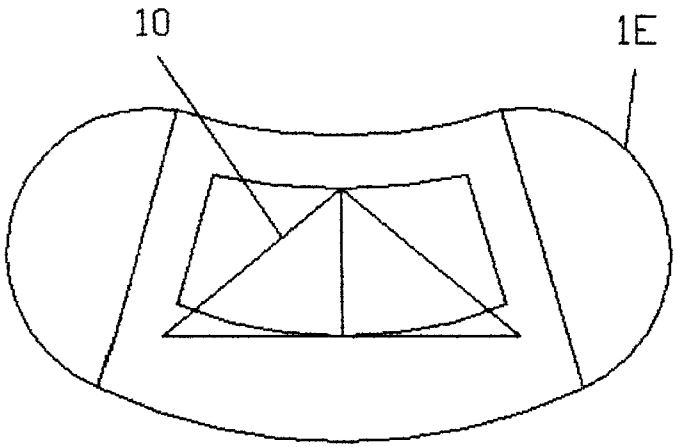
FIG. 2A is a rear elevational view of an outer side wall of the simulated time ship dining and entertainment arrangement.
Figure 3B:
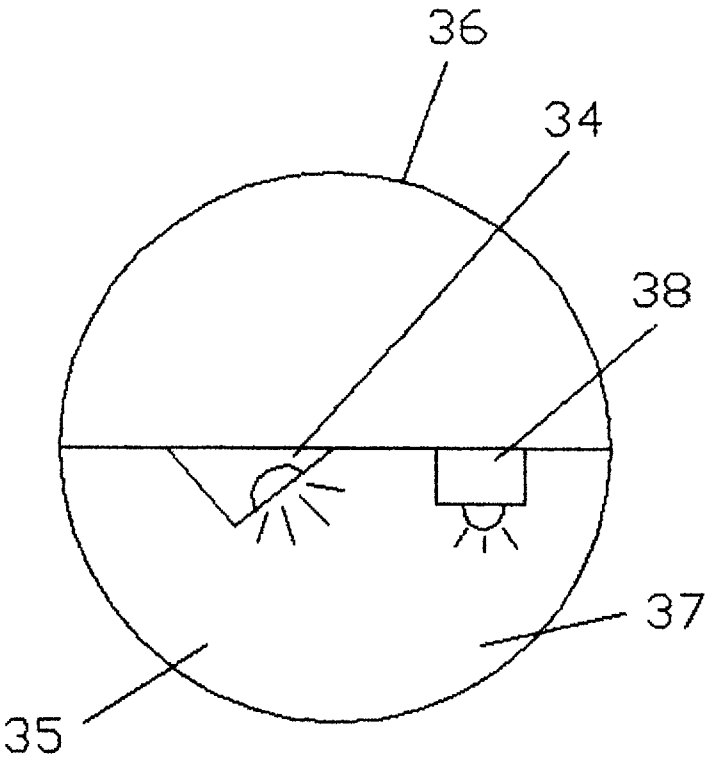
FIG. 3B is a side elevational view of an overhead display module in the simulated ship dining and entertainment arrangement.
Figure 3A:
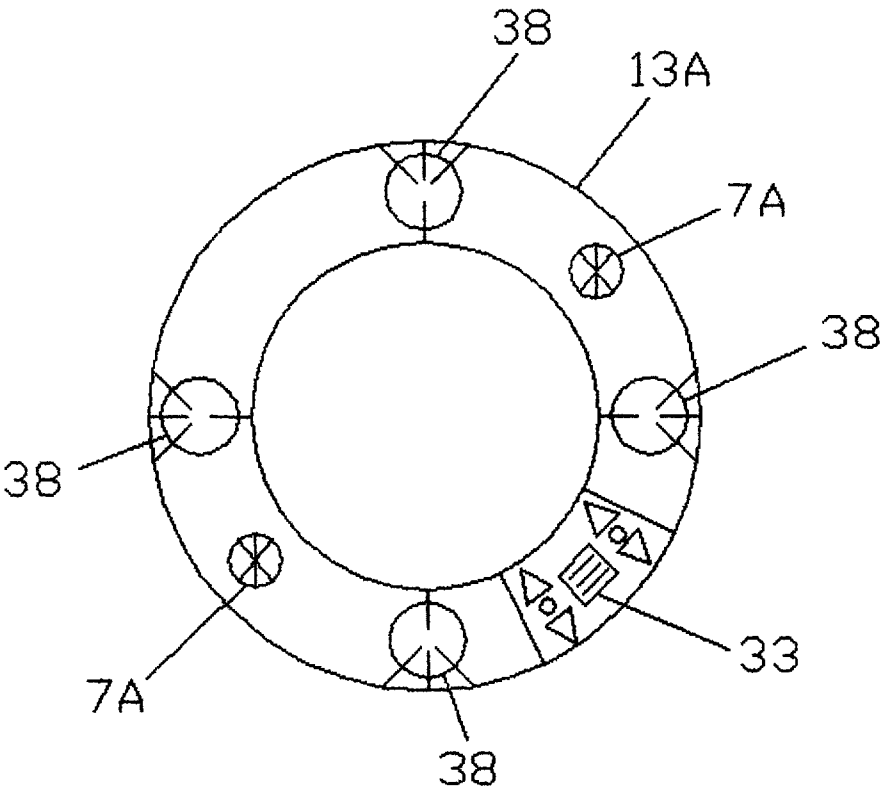
FIG. 3A is a top plan view of the control panel for the simulated time ship dining and entertainment arrangement.
Figure 4A:
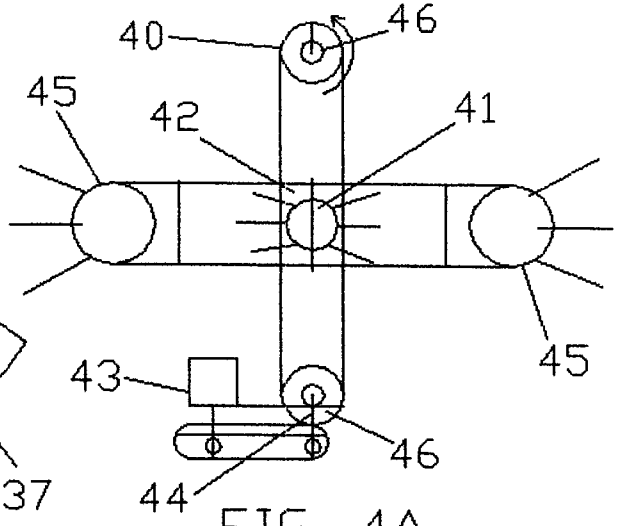
FIG. 4A is a bottom plan view of the revolving image/sound producing means disposed in the ceiling of the simulated time ship dining and entertainment arrangement.
Figure 4B:
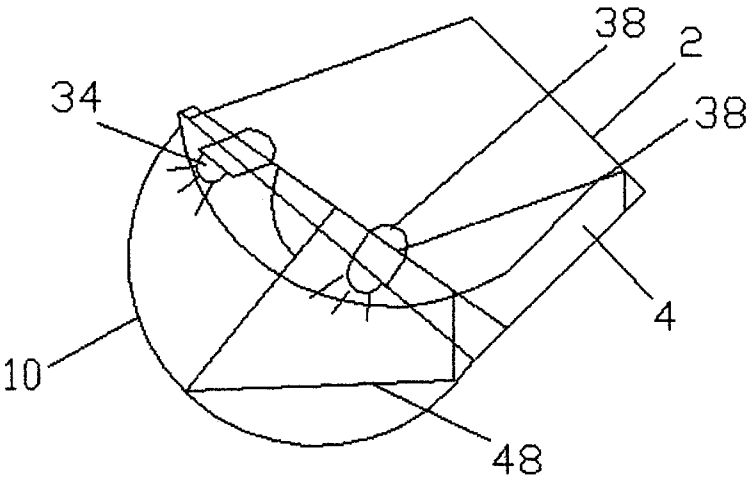
FIG. 4B is an elevational view inside a display chamber of the simulated time ship dining and entertainment arrangement.
Figure 3C:
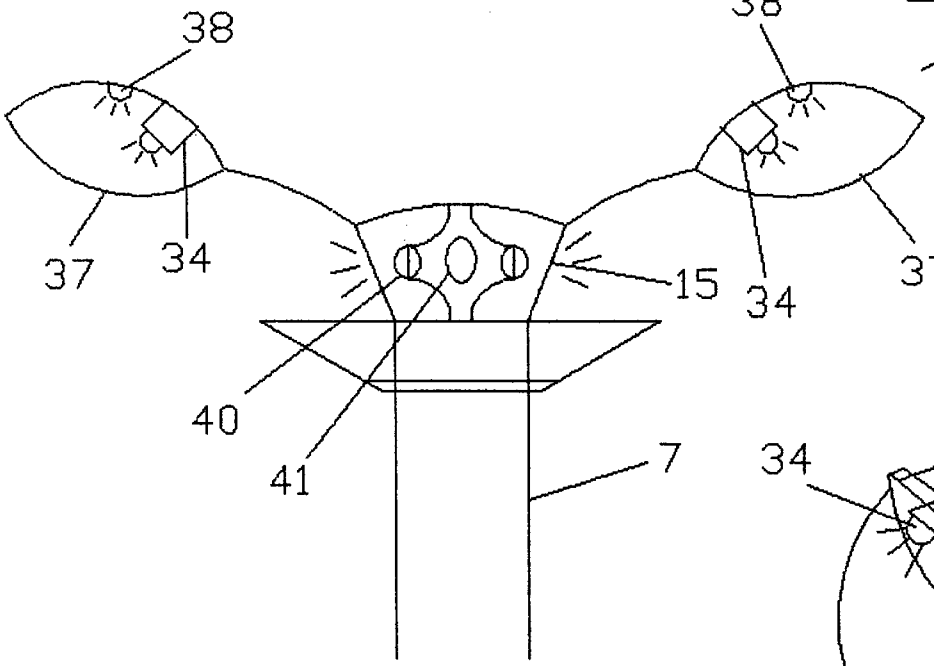
FIG. 3C is a side elevational view of the overhead display modules and the simulated engine of the simulated time ship dining and entertainment arrangement.
Figure 5A:
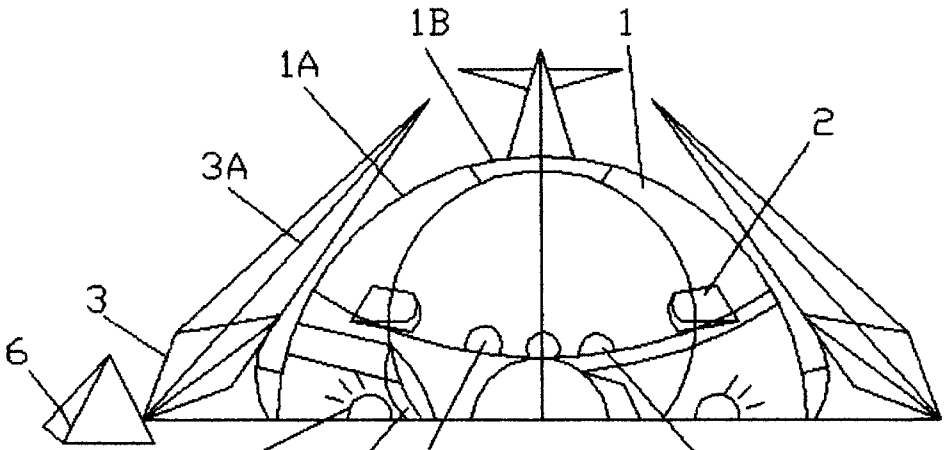
FIG. 5A is a front outside elevational view of the simulated time ship dining and entertainment arrangement.
Figure 5B:
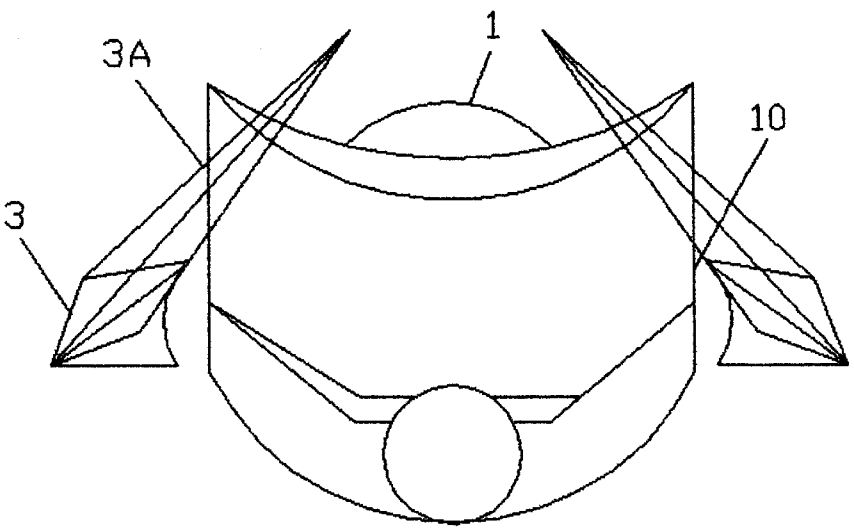
FIG. 5B a partial side view of the display chamber and feet members of the simulated time ship dining and entertainment arrangement.
Figure 4C:
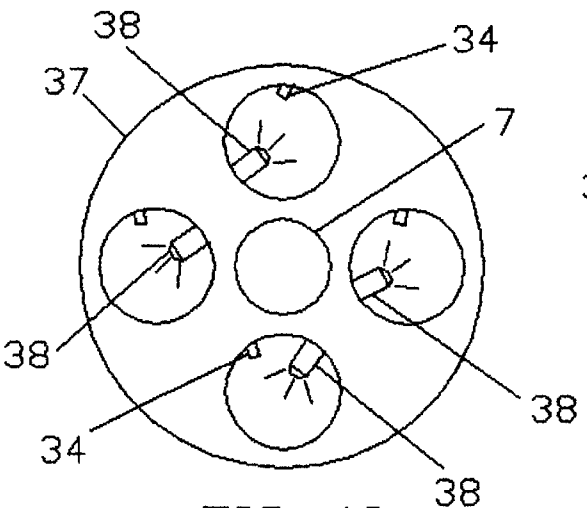
FIG. 4C is a bottom plan view of the ceiling showing in particular the overhead display modules of the simulated time ship dining and entertainment arrangement.
Figure 5D:
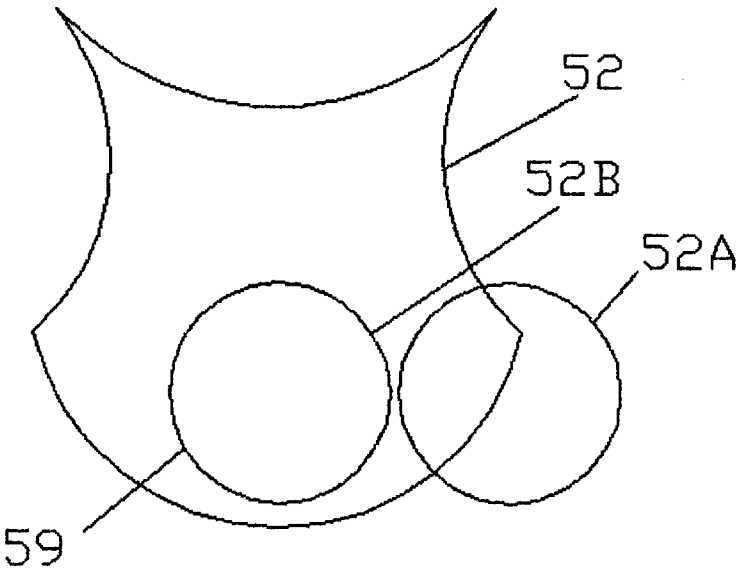
FIG. 5D is a front elevational view of the front of the simulated time ship dining and entertainment arrangement.
Figure 5C:
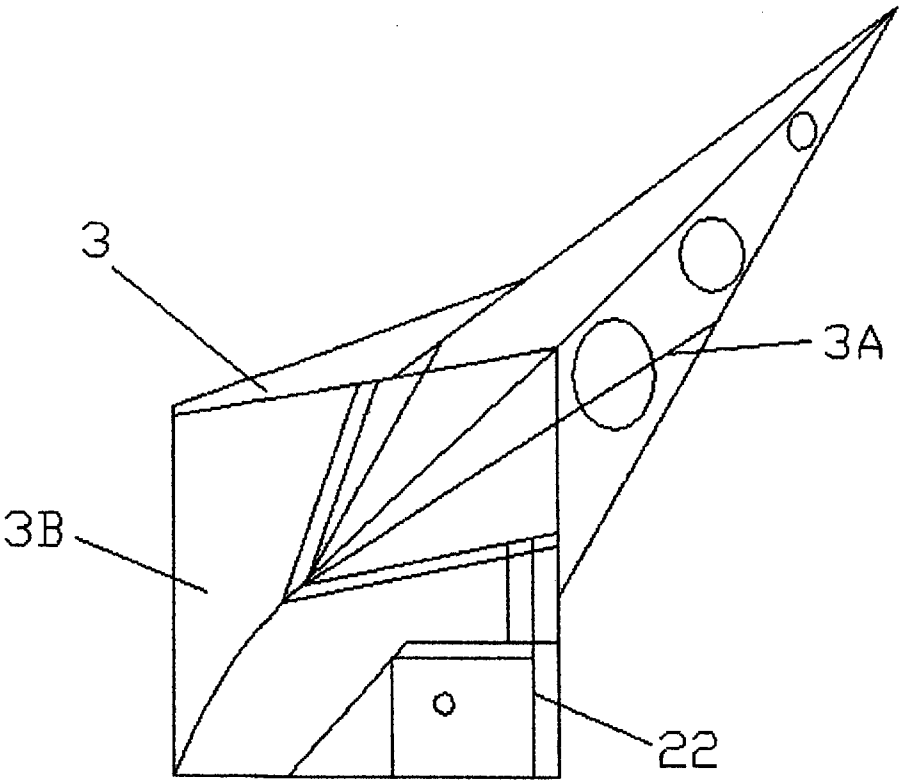
FIG. 5C is a top plan view of a feet member including the time rod of the simulated time ship dining and entertainment arrangement.
Figure 6B:
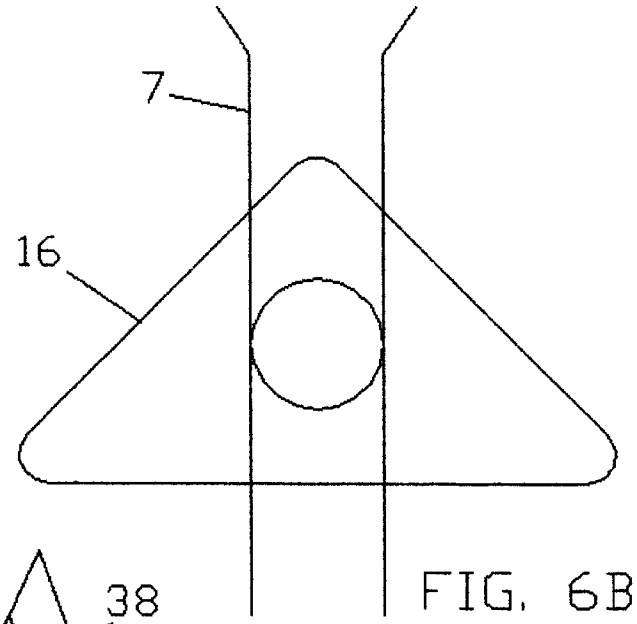
FIG. 6B is a top plan view of the simulated engine and the dining table.
Figure 6C:
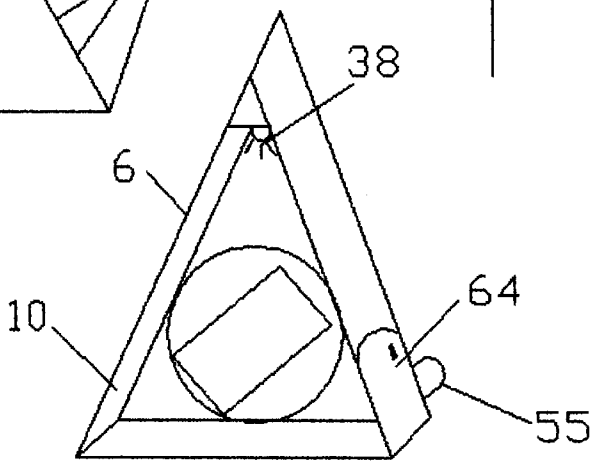
FIG. 6C is a perspective view of one of the display modules disposed outside the building structure.
Figure 6A:
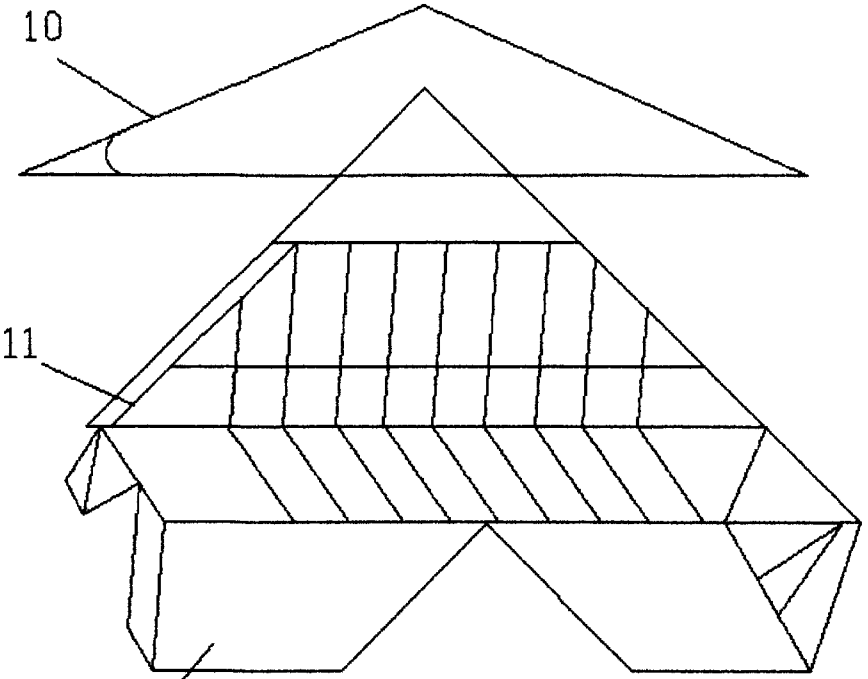
FIG. 6A is a perspective view of one of the seating members used in the simulated time ship dining and entertainment arrangement.
Figure 7C:
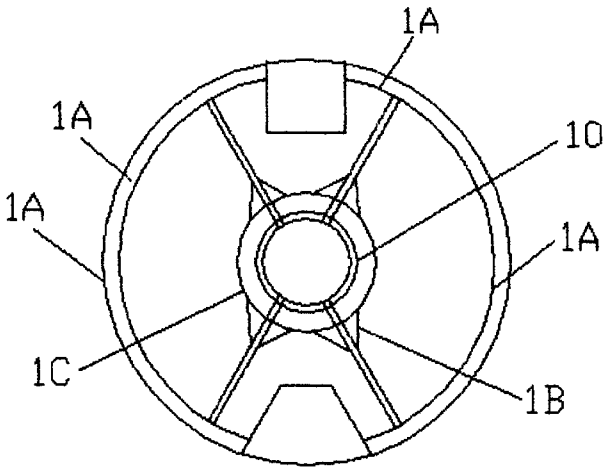
FIG. 7C is a top plan view showing in particular the arrangement of the outer and inner side walls.
Figure 7A:
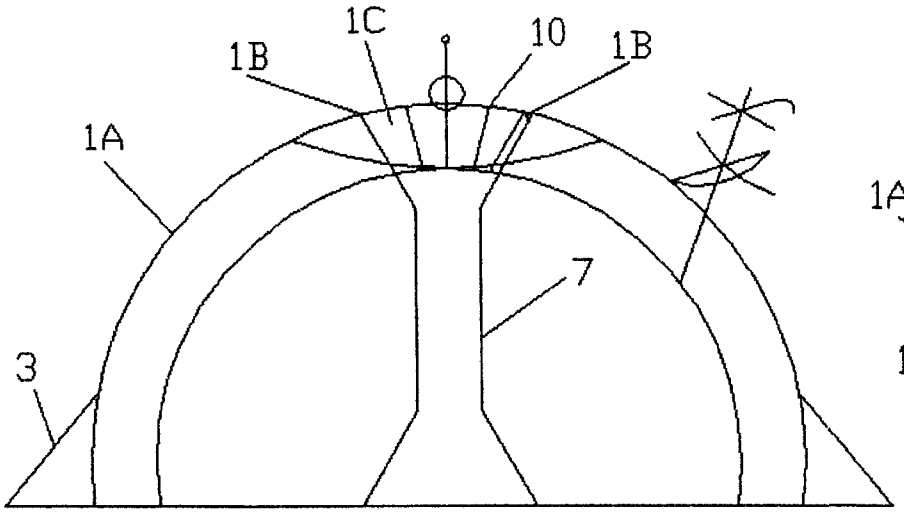
FIG. 7A is a front elevational view showing in particular the simulated engine, the inner side walls and the outer side walls.
Figure 7B:
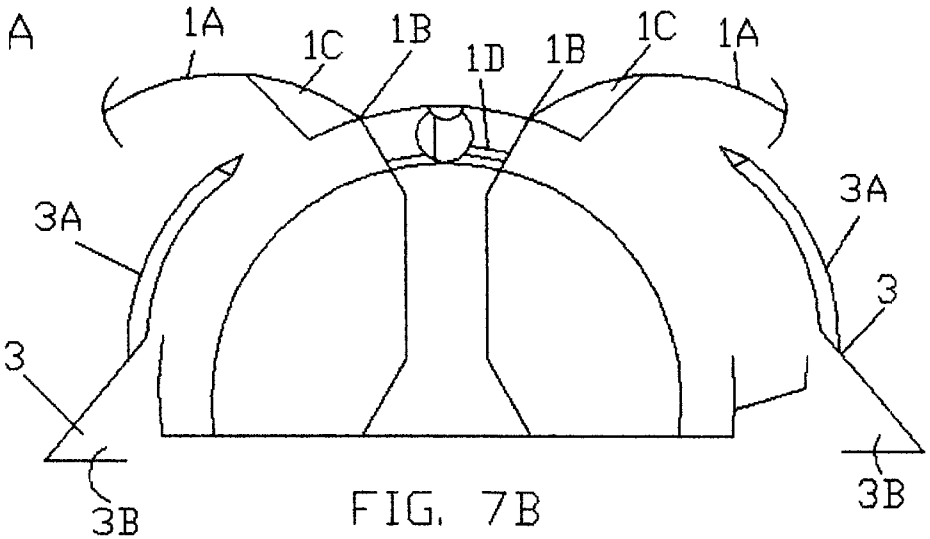
FIG. 7B is a front elevational view showing in particular the simulated engine with the outer side walls being hingedly lifted outwardly relative to the inner side walls.
Figure 8:
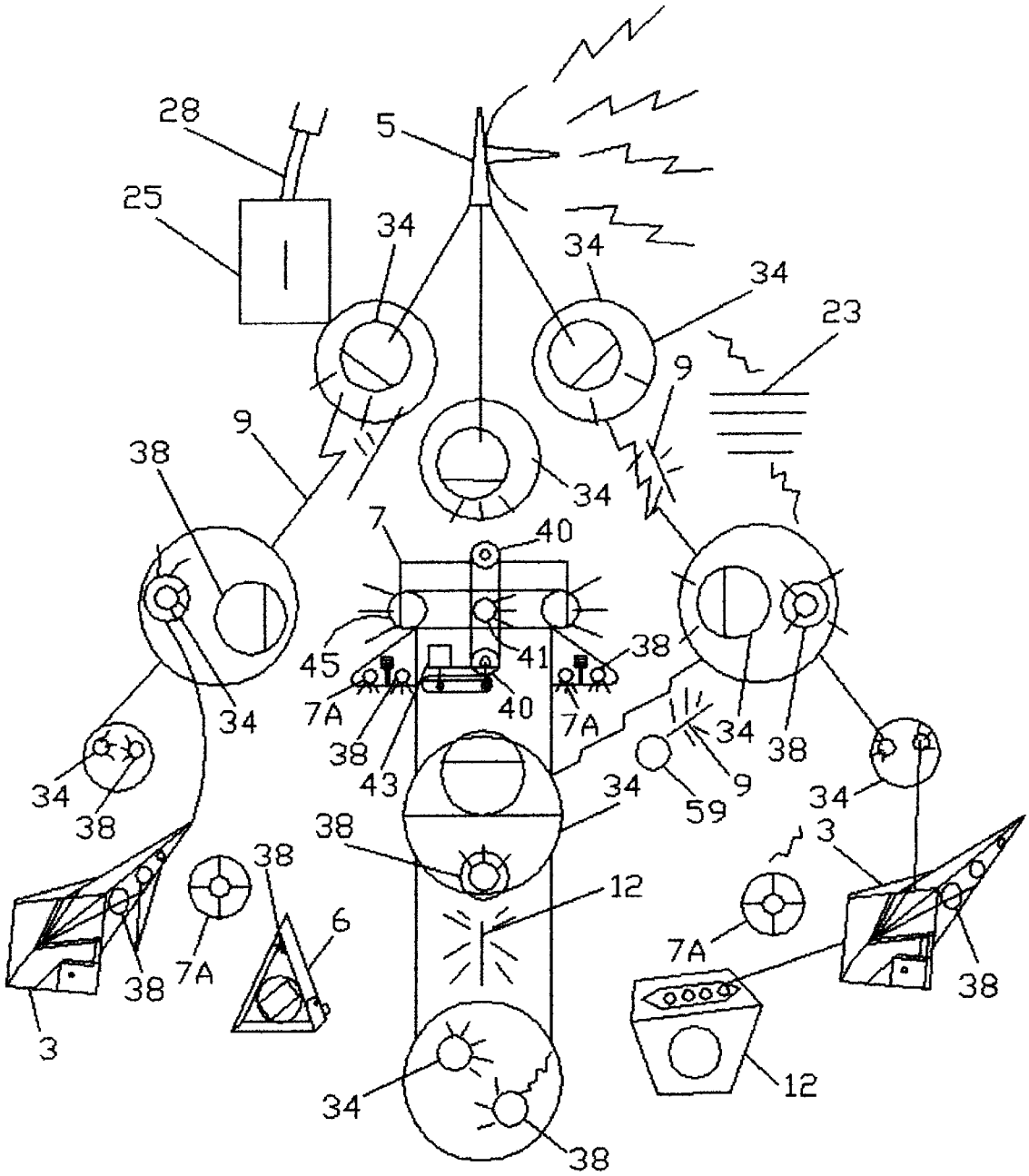
FIG. 8 is a diagram of the electrical connections used in the simulated time ship dining and entertainment arrangement.

Referring to the drawings in FIGS. 1–8, in particular, the simulated time ship dining and entertainment arrangement includes a building structure 1 such as a dome-like structure having a ceiling 1D, a roof 14 spaced from the ceiling 1D, a floor 26 having a plurality of display modules 17,37 disposed therein, inner side walls 1E with a plurality of windows 10 therein, hinged outer side walls 1A which support the roof 14 and which includes a back panel 24 including fire equipment 20, an electrical cord 28 for plugging the portable building structure 1 into an outlet, a display window 10, a fuse box 25, and an exit door 21, and which is spaced from the inner side walls 1E to form display chambers 2 therebetween, a plurality of feet members 3 conventionally attached to the outer walls 1A and extending outwardly therefrom with each feet member 3 having a storage compartment 3B therein with access inside each storage compartment 3B being made through a door 22 which is hingedly attached to the storage compartment 3B, and a plurality of lightning-bolt shaped time rods 3A each of which extend upwardly from a respective one of the feet members 3 to simulate a time ship. The simulated time ship is mounted upon conventional rollers or wheels 30 so that the structure 1 can be easily moved about as desired. The patrons would enter the building structure 1 through an entrance 52A which is at the front 52 thereof. Near the entrance 52A, there are speakers 7A sending out audible messages to the patrons as they enter the time ship.

In the storage compartments 3B of the feet members 3, there are image/sound producing projection members 34 including video recorders which are used to direct certain images on the outside of the outer walls 1A, the images essentially being certain events that happened throughout time. Also, a signal receiving and transmitting member 5 is mounted to the roof 14 of the building structure 1 and is used to receive and transmit audio and video signals such as VHF and UHF signals. The outer side walls 1A are hinged with conventional hinges 1B,1C connected to the roof 14 and are essentially made of transparent material so that images can be projected onto the outer side walls 1A from inside the building structure 1 and can be seen by the observers from outside the building structure 1. These images are projected from image/sound producing projection means 34 such as moving-picture projectors which are conventionally mounted inside the display chambers 2 disposed between the inner side walls 1E and the outer side walls 1A. Memorabilia 4 from various time periods such as dinosaurs are placed inside the display chambers 2 and their images are projected onto the outer side walls 1A.

Inside the simulated time ship, there is a simulated engine 7 which is essentially a transparent column having a top end which supports the ceiling 1D and a bottom end which rests upon the floor 29 and in addition to simulating an engine 7 for the time ship it also is a support structure 1 to help hold up the ceiling 1D. The engine 7 has various conventional lighting means 7A,38 disposed inside thereof and designed to light up to simulate the firing of the engine 7 as the time ship moves through time. A dining table 16 is conventionally mounted to the engine 7 and essentially encircles the column with conventional seating members 11 such as benches and booth-like structures disposed about the dining table 16 and resting upon the floor 29 which has a plurality of floor display modules 17 disposed in the floor 29. Each floor display module 17 is essentially a capsule having a transparent cover which is essentially flush with the floor 29 an through which the patrons inside the building structure 1 can view various memorabilia 4 placed inside the capsules. In addition to memorabilia 4 placed inside the capsules, there is conventional lighting means 38 to not only light up the capsules but also to project light through the transparent covers. In addition to seeing memorabilia 4 and images from various time periods in the floor 29, the patrons will be able to see memorabilia 4 and moving/stationary images in overhead display modules 37, each of which essentially includes a pair of semi-spherical transparent members 35,36 essentially made of glass and which are hinged to each other and conventionally fastened to form a sphere 37 when the semi-spherical transparent members 35,36 are closed upon one another. Inside each sphere 37, there is a conventional image/sound producing projection means 34, memorabilia 4 from various time periods, and other conventional lighting means 38 to illuminate the memorabilia 4 disposed inside thereof. The overhead display modules 37 are conventionally suspended from the ceiling 1D and are circumferentially arranged about the top portion of the engine 7. In addition to these overhead display modules 37, there are revolving image/sound producing means inside the engine 7 near the top end thereof. These revolving image/sound producing means include lighting members 41, conventional image/sound producing support members 46 which support the image being produced, conventional image/sound producing equipment 40,43,44 such as cameras and speakers 7A and which rotate upon the conventional image/sound producing support members 46, and also include conventional image magnifying means 45 which is mounted to the conventional image/sound producing support members 46 which are conventionally attached to the ceiling 1D. To operate all the conventional image/sound producing equipment 34,40,43,44 disposed inside and outside the building structure 1, there is a conventional communications system 33 disposed about the engine 7 and which includes a conventional control panel 13,13A having intercom means to communicate with the host and further having volume control knobs, lighting control switches, and switches to control and operate the image/sound producing equipment 34,40,43,44. The patron will be able to select which time period he/she would like to travel through by making one's selection on the control panel 13,13A. In addition, the patron will be able to order food through the intercom means. If the patron doesn't have a preference as to which time period he/she would like to travel through, the communications system is automated and is also controlled by sensors 9 located near the entrance 52A to the building structure 1 and will automatically energize the image/sound producing means 34,40,43,44 throughout the building structure 1 as the patron or patrons enter the simulated time ship which can easily and quickly expanded to make more room should there be a request for a large party by conventionally and mechanically lifting up the outer side walls 1A of the time ship and repositioning the inner side walls 1E outwardly to provide for more room inside the building structure 1 and adding more seating members 11 inside the building structure 1. In addition to all the display modules 17,29,37 located inside the building structure 1, there is also at least one display module 6 disposed outside the building structure 1 and which is essentially a triangular shape having a door 64, a display window 10, means for connecting to the time ship 55, and conventional lighting means disposed inside the module 6 for illuminating the memorabilia 4 stored inside thereof. As the patron approaches the simulated time ship, he/she will see projected images on the outer side walls 1A and also memorabilia 4 in the outside display modules 6. Inside the simulated time ship, the patron take a seat 11 around the dining table 16 which is mounted to the engine 7 and can select the time period on the control panel 13,13A and can also order the types of food wanted through the intercom means. The patron will be able to experience a vast array of foods some of which are associated with the different time periods.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A simulated time ship dining and entertainment arrangement comprising:

a building structure having a roof, a plurality of outer side walls connected to said roof, a plurality of moveable inner side walls, a ceiling connected to said inner side walls, a floor, a plurality of windows in the inner side walls, and a signal transmitting and receiving member attached to said roof;

a simulated engine extending from said floor to said ceiling and further supporting said ceiling;

a dining table disposed about said simulated engine;

a plurality of seating members arranged about the inside of said building structure;

a plurality of display modules suspended from said ceiling and disposed in said floor and arranged outside said building structure for storing and displaying various memorabilia;

a plurality of image/sound producing means disposed throughout the inside of said building structure and inside said display modules and outside said building structure; and a communications system including a control panel disposed about said simulated engine and within reach of a patron for communicating with a host of said dining and entertainment arrangement and for operating said image/sound producing means.

2. A simulated time ship dining and entertainment arrangement as described in claim 1, wherein said outer side walls are spaced from said inner side walls to form display chambers therebetween, said display chambers being used to store and display various memorabilia from different time periods all of which is visible to said patron through said windows in said inner side walls.

3. A simulated time ship dining and entertainment arrangement as described in claim 2, wherein said display chambers include said lighting means for illuminating the memorabilia displayed therein.

4. A simulated time ship dining and entertainment arrangement as described in claim 3 further includes a plurality of wheels upon which said building structure rests, for moving said building structure about as desired.

5. A simulated time ship dining and entertainment arrangement as described in claim 4 further includes a plurality of feet members connected to said building structure and each of which having a storage compartment for storing memorabilia and some of said image/sound producing means, and also each of which having a lightning-bolt shaped time rod attached thereto and extending upward therefrom.

6. A simulated time ship dining and entertainment arrangement as described in claim 2, wherein said outer side walls are hingedly attached to said roof and are capable of opened outwardly and upwardly as desired to provide more space within said building structure.

7. A simulated time ship dining and entertainment arrangement as described in claim 6, wherein said inner side walls can be moved inwardly and outwardly relative to said floor to increase and decrease floor space within said building structure as desired.

8. A simulated time ship dining and entertainment arrangement as described in claim 7, wherein said building structure is essentially a dome-like structure.

9. A simulated time ship dining and entertainment arrangement as described in claim 1, wherein said simulated engine is essentially a transparent column centrally disposed inside said building structure and having a plurality of said lighting means disposed inside thereof for simulating an operating engine.

10. A simulated time ship dining and entertainment arrangement as described in claim 9, wherein each of said display modules suspended from said ceiling include a pair of transparent semi-spherical members hingedly attached to one another and closed upon one another to form a sphere having one of said lighting means, one of said image/sound producing means, and memorabilia disposed therein.

11. A simulated time ship dining and entertainment arrangement as described in claim 10, wherein each of said display modules disposed in said floor includes a storage area having a transparent cover which is essentially flush with said floor, and having one of said lighting means, one of said image/sound producing means, and memorabilia disposed therein.

12. A simulated time ship dining and entertainment arrangement as described in claim 11, wherein said image/sound producing means includes image/sound producing support members, image/sound producing members rotatably mounted upon said image/sound producing support members, and image magnifying members.

13. A simulated time ship dining and entertainment arrangement as described in claim 12, wherein said image/sound producing support members are disposed in said ceiling about said simulated engine.

14. A simulated time ship dining and entertainment arrangement as described in claim 13, wherein said image/sound producing members disposed outside said building structure for displaying moving and stationary images upon said outer side walls, and also disposed inside said building structure for displaying moving and stationary images upon said inner side walls.

* * * * *